US012139687B2

(12) United States Patent
Nelson et al.

(10) Patent No.: US 12,139,687 B2
(45) Date of Patent: Nov. 12, 2024

(54) LUBRICATING COMPOSITIONS WITH DECARBOXYLATED ROSIN ACID

(71) Applicant: Kraton Chemical, LLC, Jacksonville, FL (US)

(72) Inventors: Lloyd A. Nelson, Savannah, GA (US); Gerald Heebner, Savannah, GA (US); Charles D. Moses, Savannah, GA (US); Jeremie Pichereau, Almere (NL); Sara Frattini, Almere (NL)

(73) Assignee: KRATON CORPORATION, Houston, TX (US)

( * ) Notice: Subject to any disclaimer, the term of this patent is extended or adjusted under 35 U.S.C. 154(b) by 0 days.

(21) Appl. No.: 18/468,915

(22) Filed: Sep. 18, 2023

(65) Prior Publication Data

US 2024/0093118 A1 Mar. 21, 2024

Related U.S. Application Data

(60) Provisional application No. 63/516,709, filed on Jul. 31, 2023, provisional application No. 63/376,008, filed on Sep. 16, 2022.

(51) Int. Cl.

| | |
|---|---|
| ***C10M 145/00*** | (2006.01) |
| ***C10M 169/04*** | (2006.01) |
| *C10N 20/00* | (2006.01) |
| *C10N 20/02* | (2006.01) |
| *C10N 20/04* | (2006.01) |
| *C10N 30/06* | (2006.01) |
| *C10N 40/00* | (2006.01) |
| *C10N 40/04* | (2006.01) |
| *C10N 40/08* | (2006.01) |
| *C10N 50/10* | (2006.01) |

(52) U.S. Cl.

CPC ..... *C10M 145/00* (2013.01); *C10M 169/041* (2013.01); *C10N 2020/017* (2020.05); *C10N 2020/02* (2013.01); *C10N 2020/04* (2013.01); *C10N 2030/06* (2013.01); *C10N 2040/042* (2020.05); *C10N 2040/044* (2020.05); *C10N 2040/045* (2020.05); *C10N 2040/08* (2013.01); *C10N 2040/40* (2020.05); *C10N 2050/10* (2013.01)

(58) Field of Classification Search

CPC ..... C10M 145/00; C10M 169/041; C10M 159/12; C10M 171/02; C10M 1/08; C10N 2020/017; C10N 2020/02; C10N 2020/04; C10N 2030/06; C10N 2040/042; C10N 2040/044; C10N 2040/045; C10N 2040/08; C10N 2040/40; C10N 2050/10

USPC ..... 508/449

See application file for complete search history.

(56) References Cited

U.S. PATENT DOCUMENTS 2,221,953 A * 11/1940 Read ..... C10M 1/08 585/254

6,592,639 B2 7/2003 Bernasconi et al.

* cited by examiner

*Primary Examiner* — Prem C Singh

*Assistant Examiner* — Francis C Campanell

(57) ABSTRACT

The disclosure relates to a lubricating composition consisting essentially of a decarboxylated rosin acid (DCR), a base oil, and optional additives, and methods for using same. The decarboxylated rosin acid has a density of 0.9 to 1.0 g/cm3 at 20° C., a viscosity of 15 to 60 cSt at 40° C., and an acid value of <50 mg KOH/g. The lubricating compositions containing the DCR is characterized as having improved anti-wear and friction reducing properties, as well as improved electrical properties, and cooling performance for use in electric and hybrid vehicles. In embodiments, the lubricating composition exhibits a wear scar diameter of <350 μm, according to ASTM D6079.

20 Claims, No Drawings

LUBRICATING COMPOSITIONS WITH DECARBOXYLATED ROSIN ACID

RELATED APPLICATIONS

This application claims priority to U.S. Provisional Application No. 63/376,008, filed on Sep. 16, 2022, and U.S. Provisional Application No. 63/516,709, filed on Jul. 31, 2023, both incorporated herein by reference in their entirety.

FIELD

The disclosure relates to the use of bio-based liquid decarboxylated rosin acid in lubricating compositions.

BACKGROUND

Lubricating oil compositions find widespread applications in various fields, including automotive and machinery. There is a growing demand to reduce the viscosity of lubricating oil in automobiles to improve fuel efficiency. However, this viscosity reduction can negatively impact the oil-film forming ability, leading to increased friction and sometimes hindering fuel economy. In some cases, the diminished oil film formation due to low viscosity can result in direct metal-to-metal contact, leading to inadequate lubrication, increased wear, and a failure to fulfill the intended function as a lubricant composition.

Moreover, lubricating oil compositions are now often being used in hybrid, electric, and fuel cell automobiles, with additional challenges. These lubricants not only must have traditional lubricating properties, but also electrical conductivity, and cooling performance. Achieving all these properties along with compatibility with automotive components is challenging.

There is still a need for a lubricating composition comprising a bio-based oil to meet the requirements of traditional lubricating oils, as well as lubricating oils used in hybrid and electric vehicles.

SUMMARY OF THE INVENTION

In an aspect, a lubricating composition is disclosed. The lubricating composition consists essentially of: at least 60 wt. % of a base oil, 0.1-40 wt. % of a decarboxylated rosin acid, and up to 35.0 wt. % of an additive. The decarboxylated rosin acid has: a density of 0.9 to 1.0 g/cm$^3$ at 20° C., a viscosity of 15 to 60 cSt at 40° C., measured according to ASTM D-445, and an acid value of <50 mg KOH/g, as measured using ASTM D1240-14 (2018). The lubricating composition exhibits a wear scar diameter of <350 μm, according to ASTM D6079.

In an aspect, a method of lubricating metal surfaces is disclosed. The method comprises supply to the metal surfaces a lubricating composition. The lubricating composition consists essentially of: at least 60 wt. % of a base oil, 0.1-40 wt. % of a decarboxylated rosin acid, and up to 35.0 wt. % of an additive. The decarboxylated rosin acid has: a density of 0.9 to 1.0 g/cm$^3$ at 20° C., a viscosity of 15 to 60 cSt at 40° C., measured according to ASTM D-445, and an acid value of <50 mg KOH/g, as measured using ASTM D1240-14 (2018). The lubricating composition exhibits a wear scar diameter of <350 μm, according to ASTM D6079.

In an aspect, the decarboxylated rosin acid can be unhydrogenated or hydrogenated.

In an aspect, the lubricating composition is used in electric or hybrid electric vehicles.

DESCRIPTION

The following terms will be used throughout the specification with the following meanings unless specified otherwise.

"At least one of [a group such as A, B, and C]" or "any of [a group such as A, B, and C]," or "selected from [A, B, and C]," means a single member from the group, more than one member from the group, or a combination of members from the group. For example, at least one of A, B, and C includes, for example, A only, B only, or C only, as well as A and B, A and C, B and C; or A, B, and C, or any other all combinations of A, B, and C. In another example, at least one of A and B means A only, B only, as well as A and B.

A list of embodiments presented as "A, B, or C" is to be interpreted as including the embodiments, A only, B only, C only, "A or B," "A or C," "B or C," or "A, B, or C."

"Major amount" means an amount of equal to or more than 50 wt. %.

"Minor amount" means an amount less than 50 wt. %.

"Lubricating oil," "lubricant composition," "lubricating composition," "lubricant" and "lubricating fluid" refer to a finished lubrication product comprising a bio-based oil (DCR), a base oil, and optionally an additive.

"Secondary oil" or "co-oil" refer to an oil used in conjunction with a base oil. The DCR can be a co-oil.

"Additive packages" mean lubricant additives which are chemical components or blends that provide one or more functions in the lubricant fluid, when used at a specific treat rate.

"Double Bond Equivalent" or DBE refers to a degree of unsaturation or a number of double/triple bonds present in a compound/molecule.

Wear Preventive Characteristics of Lubricating Fluid (Four-Ball Method) can be measured per ASTM D4172.

Lubricity of Diesel Fuels by the High-Frequency Reciprocating Rig (HFRR) can be measured per ASTM D6079.

Kinematic viscosity can be measured according to ASTM D445.

Thermal conductivity can be measured per ASTM D4308.

Dielectric constant can be measured per ASTM D924.

Electrical conductivity can be measured per ASTM D4308.

Dissipation Factor or Power Factor can be measured at 25° C. and 100° C. (as indicated below) per ASTM D924.

"Solubility Parameter" or (δ) of a solvent or polymer, refers to the square root of the vaporization energy (ΔE) divided by its molar volume (V), as in the equation $\delta=(\Delta F/V)^{1/2}$. The more similar the solubility parameters of two substances, the higher will be the solubility between them and hence the expression "like dissolves like." Hansen established that the solubility parameter of a solvent or polymer is the result of the contribution of three types of interactions: dispersion forces ($\delta D^2$), polar interactions ($\delta P^2$), and hydrogen bonds ($\delta H^2$) (Hansen, 2007; Hansen, 1967), with the total solubility (Hildebrand) parameter $\delta_T$ as the result of contribution of each of the three Hansen solubility parameters (HSP) according to: $\delta_T=(\delta 2D+\delta 2_P+\delta 2_H)^{1/2}$.

Molecular weight (MW) of compounds or components/species in a compound can be determined by MS (mass spectroscopy), preferably in combination with a chromatographic separation method like GC (gas chromatography) or HPLC (high performance liquid chromatography). In embodiments, the MW is determined by GC-MS, using a column with a highly-substituted cyanopropyl phase (e.g. Supelco SP-2330, Restek rtx-2330, or Agilent HP-88) of the size 30 m×0.25 mm×0.20 μm, with the following operating parameters: a temperature profile of 100° C. for 5.0 min, heating with 5° C./min to 250° C. and holding this temperature for 10.00 min; forming a solution with 10 mg of compound in 1 ml of a suitable solvent such as toluene, cyclohexane, etc.; injecting 1 μl of the solution with a split ratio of 1:40 at 250° C.; maintaining the flow at 1 ml/min throughout the analysis. Identification of the individual components is performed by QMS (quadrupole mass spectrometry) detector, with an ion source temperature of 200° C. and a mass range of 35-500 amu.

The disclosure relates to a lubricating composition comprising a bio-based oil, a base oil and optional additives, and methods for using same.

Bio-based Oil: The bio-based oil is a decarboxylated rosin acid (DCR). The DCR is a rosin-derived composition obtained by decarboxylating a rosin acid, or by dimerizing and decarboxylating a rosin acid and separating/removing the dimerized species. The DCR is in the form of a liquid, and can be any of an unhydrogenated crude, distilled or purified DCR, or hydrogenated DCR (hDCR), or mixtures thereof. Crude DCR is DCR containing 5-25 wt. % of higher molecular weight (450-1500 Da) components, e.g., hydrocarbons, oligomers, polymers, impurities, or dimer/trimer of fatty acids. Distilled or purified DCR refers to crude DCR having heavy fractions removed to improve color, reduce sulfur, etc. Hydrogenated DCR refers to DCR that has undergone hydrogenation for the reduction of C═C double bonds and obtain hydrogenated compounds. Unless specified otherwise, DCR herein refers to both unhydrogenated DCR (crude, distilled or purified), or hydrogenated DCR.

DCR is produced by the decomposition of rosin acids at high temperatures, e.g., 220-300° C. Rosin acids are normally solid, having a softening point of, e.g., 65-85° C. The rosin acid can be fully decarboxylated forming DCR. The rosin acid can be partially decarboxylated, forming DCR, which is a mixture of molecules, some of which contain monocarboxylic acids having a general molecular formula, e.g., $C_{20}H_{30}O_2$.

In embodiments, the DCR comprises one or more C═C groups, 40-100 wt. % of tricyclic species having 18-20 carbon atoms, 0-30 wt. % of components with <19 carbon atoms, and 40-100 wt. % of components with a molecular formula in the range from $C_{19}H_{20}$ to $C_{19}H_{34}$, based on the total weight of the DCR. In embodiments, sum of tricyclic species as aromatic and cycloaliphatic in the DCR is >50 wt. %, or >55 wt. %, or >60 wt. %, or >74 wt. %, or >90 wt. %, or up to 100 wt. %, of total weight of the DCR. Aromatic DCR is defined as DCR species having a MW of 252-256, with MW of 254 as having a reactive double bond, and cycloaliphatic DCR is defined as DCR species having a MW of 260 or 262.

In embodiments, the DCR has a C19 (MW 248-262) content of >50 wt. %, or >60 wt. %, or >70 wt. %, or >80 wt. %. In embodiments, the amount of cycloaliphatic DCR (MW 260 and 262) is >15 wt. %, or >20 wt. %, or >30 wt. %, or >40 wt. %, or >50 wt. %, or >80 wt. %, based on the total weight of the DCR.

In embodiments, total amount of tricyclic species having reactive double bond (C═C group) is <5 wt. %, <3 wt. %, <1 wt. %, or 0 wt. % of total weight of the DCR. Reactive C═C group is defined as DCR species having a MW of 254 or 258.

In embodiments, the DCR has C19 species with MWs of 254, 250, and 248 in an amount of <5 wt. %, or <3 wt. %, or <=1 wt. %, or <0.5 wt. %, or 0 wt. %.

In embodiments, the DCR has a C13 species with MWs of 174 and 180 in an amount of 5-20 wt. %, or 5-15 wt. %, or >5 wt. % or <20 wt. %.

In embodiments after hydrogenation, the amount of tricyclic species having 18-20 carbon atoms in the hDCR goes up to at least 70 wt. %, or 75-100, or 75-95, or 80-100, or 80-95 wt. %, based on total weight of the hDCR.

In embodiments before hydrogenation, the unhydrogenated DCR contains C19 species with a MW of 262 in an amount of 5-20 wt. %, or 5-15 wt. %, or <25 wt. %, or <20 wt. %, or <15 wt. %. After hydrogenation, the hDCR contains C19 species with a MW of 262 in an amount of 25-100 wt. %, or 25-90 wt. %, or 25-80 wt. %, or 40-75 wt. %, or 50-70 wt. %, or >25 wt. %, or >35 wt. %, or >50 wt. %, or >75 wt. %.

In embodiments before hydrogenation, the unhydrogenated DCR contains C19 species with a MW of 260 in an amount of 5-25 wt. %, or 10-20 wt. %, or >5 wt. %, or >10 wt. %, or >15 wt. %, or <20 wt. %. After hydrogenation, the hDCR contains C19 species with a MW of 260 in an amount of 0-5 wt. %, or 0-3 wt. %, or 0-1 wt. %, or <5 wt. %, or <2 wt. %, or 0 wt. %.

In embodiments before hydrogenation, the unhydrogenated DCR contains C19 species with a MW of 256 in an amount of 35-55 wt. %, or 40-50 wt. %, or >37 wt. %, or >40 wt. %, or >45 wt. %. After hydrogenation the hDCR contains C19 species with a MW of 256 in an amount of 0-40 wt. %, or 5-35 wt. %, or 10-30 wt. %, or <40 wt. %, or <30 wt. %.

In embodiments before hydrogenation, the unhydrogenated DCR contains C19 species with a MW of 252 in an amount of 5-20 wt. %, or 5-15 wt. %, >5 wt. %, or >10 wt. %. After hydrogenation, the hDCR contains C19 species with a MW of 252 in an amount of 0-5 wt. %, or 0-3 wt. %, or <5 wt. %, or <3 wt. %, or <1 wt. %, or 0 wt. %.

In embodiments before hydrogenation, the unhydrogenated DCR contains C13 species with a MW of 180 in an amount of 0-5 wt. %, or 0-3 wt. %, or <5 wt. %, or <2 wt. %, or <1 wt. %, or 0 wt. %. After hydrogenation, the hDCR contains C13 species with a MW of 180 in an amount of 0-25 wt. %, or 5-20 wt. %, or 5-15 wt. %, or >5 wt. %, or >7 wt. %, or >10 wt. %.

In embodiments before hydrogenation, the unhydrogenated DCR contains C13 species with a MW of 174 in an amount of 5-25 wt. %, 5-20 wt. %, or 5-15 wt. %, or >5 wt. %, or >10 wt. %, or <20 wt. %. After hydrogenation, the hDCR contains C13 species with a MW of 174 in an amount of 0-5 wt. %, or 0-3 wt. %, or <5 wt. %, of <2 wt. %, or 0 wt. %.

The MW of the species in unhydrogenated DCR and hDCR as measured using the analytical methods previously specified (e.g., MS, MS/GC/HPLC, and GC-MS) can be identified by the following retention profile: MW of 174 g/mol, 7.0-8.5 minutes; MW of 180 g/mol, 2.5-4.0 minutes; MW of 248 g/mol, 32.5-34.5 minutes; MW of 250 g/mol, 26.0-31.0 minutes; MW of 252 g/mol, 24.5-31.0 minutes; MW of 254 g/mol, 16.5-25.0 minutes; MW of 256 g/mol, 16.5-25.0 minutes; MW of 260 g/mol, 11.0-16.0 minutes; and MW of 262 g/mol, 11.0-16.0 minutes. For components with overlapping retention time ranges, the mass spectrum of each peak is used to identify the MW of the component. Components with the same MW (isomers) are clustered and the total amount per isomer is reported.

In embodiments, the HDCR comprises at least 5 isomers, or 10 isomers, or 20 isomers, or 50 isomers, or 100 isomers of a species having a molecular formula of $C_{19}H_{34}$ and a MW of 262 g/mol.

In embodiments after hydrogenation, the hDCR comprises C=C double bonds in amounts of <40%, or <30%, or <20%, or <15%, or <10%, or <5%, or >1%, or 1-40%, or 2-20%, or 1-10%.

In embodiments after hydrogenation, the hDCR comprises an average Double Bond Equivalent in an amount of 0.1-2, or 0.2-1.5, or 0.5-1.4, or 0.5-2, or <2, or <1.8, or <1.5, or <1.2, or >0.1.

In embodiments, DCR is characterized as having a m/z (mass/charge) value in the range of 170-280, or 220-280, or 230-270, or 234-262, or 235-265, or >230, or <265, measured by GC-FID-MS.

In embodiments, DCR is characterized as having an oxygen content of <5%, or <3%, or <2%, or <0.9%, or <0.5, or <0.2%, or <0.1%, or 0-5%, or 0-3%, or 0-2%, or 0-1%. The oxygen content (in %) can be calculated as oxygen to carbon ratio, or the sum of oxygen atoms present divided by sum of carbon atoms present, with the number of oxygen and carbon atoms being obtained from elemental analyses.

In embodiments, unhydrogenated DCR is characterized as having a lower acid value (carboxylic acid content) than the rosin acid feedstock for making the DCR. In embodiments, the DCR has an acid value of <50, or <45, or <40, or <35, or <30, or <25, or <20, or <15, or <10, or <7, or <5, or 0.5-40, or 0.5-30, or 0.5-20, or 1-20, or 1-15, or 1-15, or 1-10 mg/KOH, as measured using ASTM D1240-14 (2018) or ASTM D465.

In embodiments, hDCR has an acid value of <1, or <0.8, or <0.5, or <0.2, or 0.01-1, or 0.1-0.8, or 0.01-0.5 mg KOH/g, as measured using ASTM D1240-14 (2018) or ASTM D465.

In embodiments, DCR has a density of 0.9-1.0, or 0.91-0.99, or 0.92-0.98, or 0.93-0.97, or 0.94-0.96, or >0.9, or <1.1 g/cm$^3$.

In embodiments, DCR is characterized as having viscosities comparable to those of petrochemical base oils, due in part to its relatively high molecular weights, for example, a viscosity of 5-60, or 10-60, 15-60, or 5-55, or 10-50, or 10-45, or 15-40, or >5, or >10, or >20, or >25, or >28, or <45, or <50, or <60 cSt according to ASTM D-445, measured at 40° C.

In embodiments, unhydrogenated DCR has an aniline point of 3-40° C., or 5-40° C., or 5-30° C., or 5-25° C., or 2-20° C., or 5-20° C., or 5-15° C., or <25° C., or <20° C., or >3° C., or >5° C., or >8° C., according to ASTM D611.

In embodiments, hDCR has an aniline point of 20-80° C., 30-70° C., 30-60° C., 40-50° C., or >20° C., or >30° C., or >40° C., or <70° C., according to ASTM D611.

In embodiments, unhydrogenated DCR has a pour point of −40 to +10° C., or −35 to +8° C., −30 to +5° C., or −30 to +0° C., or −30 to −5° C., or −28 to 0° C., or −28 to −5° C., or −28 to −10° C., or >−40° C., or >−30° C., or >−28° C., or <+5° C., or <+10° C., according to ASTM D97.

In embodiments, hDCR has a pour point of −40 to −10° C., or −35 to −20° C., or −35 to −25° C., or <0° C., or <−5° C., <−10° C., or >−40° C., or >−35° C., or according to ASTM D97.

In embodiments, unhydrogenated DCR has a flash point of 135-180° C. or 135-175° C., or 135-165° C., or 135-160° C., or 140-175° C., or 140-160° C., or 140-158° C., or 140-155° C., or >135° C., or >140° C., or <175° C., or <165° C., or <160° C., according to ASTM D92.

In embodiments, hDCR has a flash point of 95-140° C., or 100-135° C., or 95-135° C., or <140° C., or <135° C., or >95° C., or >100° C., according to ASTM D92.

In embodiments, DCR has a boiling point of 200-390° C., or 210-390° C., or 235-390° C., or 280-380° C., or 290-370° C., or 300-360° C., or >290° C., or >230° C., or >210° C., or <400° C., or <370° C., measured according to D2887.

In embodiments, unhydrogenated DCR has a Gardner Color of 0-12.0, or 0.5-12.0, or 0.8-12.0, or 0.9-11, or 1.0-10.0, or 1.0-6.0, or 1.0-5, or >0, or >1.0, or >1.2, or <10.0, or <7.0, or <6.0, or <5.0, or <2.4, or <3.0, according to ASTM D6166.

In embodiments, hDCR has a Gardner Color of <1, or <0.8, or <0.5, or <0.2, or 0.1-1, or 0.15-0.8, or 0.1-0.5, according to ASTM D6166.

In embodiments, unhydrogenated DCR has a sulfur content of <500 ppm (0.05 wt. %), or <300 ppm (0.03 wt. %), or <200 ppm (0.02 wt. %), or <100 ppm (0.01 wt. %), or <10 ppm (0.001 wt. %), or 20-700 ppm (0.002-0.7 wt. %), 30-500 ppm (0.003-0.5 wt. %), or 40-400 ppm (0.004-0.4 wt. %), or 40-300 ppm (0.004-0.3 wt. %), or 40-200 ppm (0.004-0.2 wt. %), based on total weight of the DCR, measured according to ASTM D5453.

In embodiments, hDCR has a sulfur content of 0.001-10 ppm, or 0.001-5 ppm, or <10 ppm, or <8 ppm, or <5 ppm, or >0.001 ppm, measured according to ASTM D5453.

In embodiments, DCR has a VOC of <5, or <4.75, or <4.5, or <4.25, or <4.0, or <3.75, or <3.5, or <3.25, or <3.0, or <2.75, or <2.5, or <2.25, or <2.0, or <1.5, or <1.0, or <0.5 wt. %, based on total weight of the DCR. The VOC of the DCR is measured according to methods: i) summing the percent by weight contribution from all VOCs present in the product at 0.01% or more, or ii) according to the EPA (Environmental Protection Agency) method 24 or equivalent.

In embodiments, DCR has a Kb (Kauri butanol) value of 25-90, or 30-85, or 35-80, or 40-75, or 45-70, or 50-65, or >40, or >50, or >60, or >70, or >80, according to ASTM D1133.

In embodiments, DCR has a viscosity index of <−100, or <−110, or <−115, or <−120, measured according to ASTM D2270. The viscosity index is an arbitrary, unit-less measure of a fluid's change in viscosity relative to temperature change, for example, index of viscosity at 40° C. and viscosity at 100° C.

In embodiments, DCR has a δD value of 14-18, or 14.2-17.8, or 14.5-17.5, or 15-17, or 15.2-16.5; a δP value of 3-6, or 3.2-5.5, or 3.4-5.2, or 3.5-5.0; and δH value of 7-10, or 7.5-9.5, or 8-9, or 8.2-8.8.

In embodiments, unhydrogenated DCR has a surface tension of 25-50, or 28-45, or 30-40 dynes/cm, according to ASTM D1331.

In embodiments, DCR has a thermal conductivity of 0.05-0.2, or 0.07-0.17, or 0.08-0.015 W/Mk, according to ASTM D4308.

In embodiments, DCR has a dielectric constant of 1-5, or 1-4, or 2-4, or 2-3, or 2.0-2.75, according to ASTM D924.

In embodiments, DCR has a specific heat capacity of 1475-1800, or 1500-1750, or 1500-1700 J/kg K, according to ASTM E1269.

In embodiments, DCR has an electrical conductivity of <3, or <2, <1, or 0.1-3, or 0.1-2, or 0.1-1 Ps/m, according to ASTM D4308.

In embodiments, DCR has a Power Factor at 25° C. of 0.001-2, 0.001-1, 0.001-0.1, or 0.005-0.05, or <2, or <1.5 or <1, or <0.5, or <0.25.

In embodiments, unhydrogenated DCR has a Power Factor at 100° C. of 1-3, or 1.5-3, or 2-2.5, or >1, or >2 or <3, according to ASTM D924.

In embodiments, hDCR has a Power Factor at 100° C. of 0.01-1, or 0.1-0.75, or <1, or >0.05, according to ASTM D924.

In embodiments, DCR is present in an amount of 0.1-40 wt. %, 0.1-30 wt. %, 0.1-25 wt. %, or 0.1-20 wt. %, or 0.1 to 10 wt. % or 0.1 to 5 wt. %, or 0.25 to 3 wt. %, or 0.5 to 2 wt. %, or <15 wt. %, or <10 wt. %, or <5 wt. %, based on the total weight of the lubricating composition.

Base oil: The lubricant composition can comprise one or more base oils. The base oils may be chosen from the base oils conventionally used in lubricant oils, such as mineral, synthetic or natural, animal or plant oils or mixtures thereof. In embodiments, the base oil is a mixture of several base oils.

In embodiments, the base oils are mineral or synthetic oils in groups I to V according to API classification (or equivalents, e.g., ATIEL classification) as shown below:

TABLE 1

| | Content of saturates (%) | Sulfur content (%) | Viscosity index (VI) |
|---|---|---|---|
| Group I Mineral oils | <90 | >0.03 | 80 ≤ VI < 120 |
| Group II Hydrocracked oils | ≥90 | ≤0.03 | 80 ≤ VI < 120 |
| Group III Hydrocracked or hydroisomerized oils | ≥90 | ≤0.03 | ≥120 |
| Group IV | Poly-α-olefins (PAO) | | |
| Group V | Esters and other bases not included in groups I to IV | | |

In embodiments, mixtures of synthetic and mineral oils, are biobased. There is generally no limit as regards the use of different base oils for preparing the compositions, other than the fact that they have properties, e.g., viscosity, viscosity index or resistance to oxidation, suitable for propulsion systems of an electric or hybrid vehicle.

In embodiments, the base oils are synthetic oils, e.g., esters of carboxylic acids and of alcohols, poly-α-olefins (PAO) and polyalkylene glycols (PAG) obtained by polymerization or copolymerization of alkylene oxides comprising from 2 to 8 carbon atoms, in particular from 2 to 4 carbon atoms. In embodiments, PAOs are obtained from monomers comprising from 4 to 32 carbon atoms, for example from octene or decene.

In embodiments, the base oil is present in an amount of at least 50 wt. %, or 60 wt. %, or >65 wt. %, or >70 wt. %, or >75 wt. %, or 50-99.9 wt. %, or 60 to 99 wt. %, or 65 to 90 wt. %, or 70 to 85 wt. %, with respect to the total weight of the lubricating composition.

Additives: In embodiments, the lubricating composition further comprises additives selected from antioxidants, anti-wear agents, detergents such as metal detergents, rust inhibitors, dehazing agents, demulsifying agents, metal deactivating agents, friction modifiers, pour point depressants, antifoaming agents, co-solvents, package compatibilizers, corrosion-inhibitors, ashless dispersants, dyes, extreme pressure agents, and mixtures thereof.

Examples of antioxidants include phenolic antioxidants, aromatic amine antioxidants, sulfur containing antioxidants, and organic phosphites, metallic antioxidants such as copper-containing and molybdenum-containing antioxidants, among others.

Examples of detergents include oil-soluble neutral, low overbased, medium overbased and high overbased sulfonates, borated sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium.

Suitable friction modifiers include metal containing and metal-free friction modifiers, including imidazolines, aliphatic fatty acid amides, aliphatic amines, succinimides, alkoxylated aliphatic amines, ether amines, alkoxylated ether amines, amine oxides, amidoamines, nitriles, betaines, quaternary amines, imines, amine salts, amino guanidine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Corrosion inhibitors can include benzotriazole-, tolyltriazole-, thiadiazole-, and imidazole-type compounds, half esters or amides of dodecylsuccinic acid, phosphate esters, thiophosphates, alkyl imidazolines, sarcosines and combinations thereof. Rust inhibitors can include nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof. In embodiments, mixtures of corrosion inhibitors and rust inhibitors are used.

Examples of demulsifiers include anionic surfactants (e.g., alkyl-naphthalene sulfonates, alkyl benzene sulfonates and the like), nonionic alkoxylated alkyl phenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and combinations thereof.

Examples of extreme pressure additives can include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thiaketones, epithio compounds, sulfur-containing acetal derivatives, co-sulfurized blends of terpene and acyclic olefins, and polysulfide olefin products, amine salts of phosphoric acid esters or thiophosphoric acid esters and combinations thereof.

Anti-wear agents include a phosphoric acid ester or salt thereof, a phosphate ester(s); a phosphite; a phosphonate, a phosphorus-containing carboxylic ester, ether, or amide; oil soluble amine salts of phosphorus compounds, a sulfurized olefin; thiocarbamate-containing compounds including, thiocarbamate esters, alkylene-coupled thiocarbamates, and bis(S-alkyldithio carbamyl) disulfides; and mixtures thereof.

Examples of viscosity modifiers include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. In embodiments, lubricating composition optionally contains one or more dispersant viscosity modifiers in addition to a viscosity modifier or in lieu of a viscosity modifier. Suitable dispersant viscosity modifiers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

Examples of dispersants include ashless dispersants selected from mono- or bis-succinimides having at least one straight or branched alkyl group or alkenyl group with 40 to 400 carbon atoms in the molecule, benzylamines having at least one alkyl group or alkenyl group with 40 to 400 carbon atoms in the molecule, polyamines having at least one alkyl group or alkenyl group with 40 to 400 carbon atoms in the molecule, boron compounds thereof, and derivatives modified with carboxylic acids, phosphoric acid, or the like, and mixtures thereof.

Antifoam agents used to reduce or prevent the formation of stable foam include silicones, polyacrylates, or organic polymers. Foam inhibitors include polysiloxanes, copolymers of ethyl acrylate and 2-ethylhexylacrylate and optionally vinyl acetate.

Thickeners such as polyisobutylene (PIB) and polyisobutenyl succinic anhydride (PIBSA) can be used to thicken lubricant compositions.

Examples of seal swell agents include esters, adipates, sebacates, azealates, phthalates, sulfones, alcohols, alkylbenzenes, substituted sulfolanes, and aromatics.

Examples of pour point depressants include esters of maleic anhydride-styrene, polymethacrylates, polymethylmethacrylates, polyacrylates, and polyacrylamides.

Examples of metal deactivators include include disalicylidene propylenediamine, triazole derivatives, thiadiazole derivatives, and mercaptobenzimidazoles.

In embodiments, the lubricating composition further comprises an additive selected from an anti-wear component or extreme pressure component in a weight ratio of anti-wear or extreme pressure component to DCR of 10:90 to 90:10, or 20:80 to 80:20, or 20:80 to 75:25, or 25:75 to 80:20, or 25:75 to 75:25, or 30:70 to 70:30, or 40:60 to 60:40, or 40:60 to 50:50. The anti-wear and/or extreme pressure additives are selected from fatty acids, estolides, and sulfur-containing, phosphorus-containing, sulfuric-phosphoric-containing extreme pressure additives, and mixtures thereof. Fatty acids are carboxylic acids with 8 to 40 carbon atoms, typically 8 to 25 carbon atoms. The fatty acids can be unsaturated or saturated, can contain one or more double carbon-carbon bonds, and can be of natural or synthetic origin. The fatty acids can also be dimerized and trimerized forms or blends thereof. In embodiments, the fatty acids are hydrogenated, isomerized, or purified. In embodiments, the fatty acid is a tall oil fatty acid (TOFA). Examples of sulfur-containing, phosphorus-containing, and sulfuric-phosphoric-containing extreme pressure additives include phosphorous acid esters, thiophosphorous acid esters, dithiophosphorous acid esters, trithiophosphorous acid esters, phosphoric acid esters, thiophosphoric acid esters, dithiophosphoric acid esters, trithiophosphoric acid esters, amine salts thereof, metal salts thereof, derivatives thereof, dithiocarbamates, zinc dithiocarbamates, molybdenum dithiocarbamates, disulfides, polysulfides, sulfurized olefins, and sulfurized fats and oils, and mixtures thereof.

Additives can be added individually or be included as additive packages for use in lubricating compositions.

In embodiments, the additives in lubricating compositions are present in an amount up to 35.0 wt. %, or 0.01 to 30 wt. %, or 0.05 to 25.0 wt. %, or 0.1 to 20.0 wt. %, or 0.5 to 10.0 wt. %, based on the total weight of the lubricating composition.

Properties of Bio-based Oil: Bio-based oil (DCR) has improved four-ball anti-wear properties and high frequency reciprocating rig test properties when compared to other commonly used lubricants, e.g., paraffinic oil, naphthenic oil, etc. The bio-based oil is also compatible with various additives, e.g., viscosity improvers, anti-wear/extreme pressure, etc., and base oils.

In embodiments, the DCR has a coefficient of friction (CoF), according to ASTM D6079 or ASTM D4172, of <0.20, <0.15, or <0.13, or <0.11, or 0.050-0.15, or 0.07-0.13.

In embodiments, the unhydrogenated DCR has a coefficient of friction (CoF), according to ASTM D6079, of at least 2%, or at least 5%, or at least 10%, or at least 15%, or at least 20% smaller than paraffinic oil, naphthenic oil, isopropyl oleate, or oleic acid methyl ester to the metal.

In embodiments, the DCR has a wear scar diameter (according to ASTM D6079) of <350, or <300, <200, or <190, or <180 or <175, or <170, or <160, or <155 μm, according to ASTM D6079.

In embodiments, the unhydrogenated DCR has a percent film (according to ASTM D6079) of at least 85%, or >90%, or >92%, or >95%.

In embodiments, the DCR has an improved hydrolytic stability when compared to methyl oleate and isopropyl oleate. The hydrolytic stability of the DCR was evaluated according to ASTM D2619. In embodiments, the DCR has a weight loss of a copper specimen on a hydrolytic stability test of <0.5, or <0.4, or <0.3, or <0.25, or <0.2 mg/cm$^2$. In embodiments, the DCR has an acid value in the aqueous layer of <5 mg KOH/g, or <4 mg KOH/g, or <3 mg KOH/g, or 1-5 mg KOH/g, or 2-4 mg KOH/g.

Method to Prepare Lubricating Composition: In embodiments, the bio-based oil (DCR) is mixed with a base oil and optional additives to form a lubricating composition. The components can be mixed at the same time, or in certain sequences. The bio-based oil and optional additives (individually or as part of an additive package) may be added to the base oil at any stage of production, subsequent storage, shipment, or delivery.

In embodiments, the bio-based oil (DCR) can be first mixed with the additives or additive packages prior to adding to the base oil, or split into portions and mixed separately into additives/additive packages and the base oil, prior to final mixing to form the lubricating composition.

Properties of Lubricating Composition Containing Bio-based Oil: The lubricating compositions made with the bio-based oil is characterized as having good stability and compatibility when used with commonly used additives in lubricating applications, e.g., improved four-ball anti-wear properties and high frequency reciprocating rig test properties.

In embodiments depending on the amount of bio-based oil DCR, the lubricating composition has a wear scar diameter (according to ASTM D6079) of <400, <350, or <300, according to ASTM D6079.

In embodiments, the lubricating composition containing bio-based oil DCR as well as an extreme pressure/anti-wear additive has a wear scar diameter of <350, or <300, or <250, or <225, or <200 according to ASTM D6079.

In embodiments, the lubricating composition containing bio-based oil DCR and at least an additive has a wear scar diameter of <850, or <825, or <800, or <775, or <750, or >300 according to ASTM D4172.

In embodiments depending on the amount of unhydrogenated bio-based oil DCR, the lubricating composition has a percent film (according to ASTM D6079) of at least 65%, or >70%, or >75%, or >80%, or >85%.

In embodiments, the lubricating composition with bio-based oil DCR as well as an extreme pressure/anti-wear additive has a percent film (according to ASTM D6079) of at least >85%, or >90%, or >95%.

In embodiments, the lubricating composition with bio-based oil DCR has a coefficient of friction (CoF) (according to ASTM D6079 or ASTM D4172) of <0.20, <0.17, or <0.15, or <0.14, or 0.03-0.20, or 0.5-0.15.0

In embodiments, the lubricating composition with bio-based oil DCR as well as an extreme pressure/anti-wear additive has a coefficient of friction (CoF) (according to ASTM D6079) of <0.17, or <0.15, or <0.14, or 0.050-0.20, or 0.10-0.15.

In embodiments, the lubricating composition with bio-based oil DCR has an electrical conductivity of 10 pS/m to 80,000 pS/m.

In embodiments, the lubricating composition with bio-based oil DCR has a dielectric constant of 1-5, or 1-4, or 1.5-4.

In embodiments, the lubricating composition with bio-based oil DCR has a kinematic viscosity of 2-20 cSt, or 3-15 cSt (according to ASTM D445 at 100° C.).

Applications and Methods for Use: The lubricating composition may be used as a marine lubricant, a natural gas engine lubricant, a combustion engine oil, rail road engine oil, or a functional fluid, including but not limited to tractor hydraulic fluids, power transmission fluids including automatic transmission fluids, continuously variable transmission fluids and manual transmission fluids, hydraulic fluids, gear oils, power steering fluids, fluids used in wind turbines and fluids related to power train components.

In embodiments, the lubricating composition is used as automotive engine oil (spark or compression ignition, direct or port injected), hybrid engine oil, engine coupled to an electric motor/battery system in a hybrid vehicle oil, marine oil, gear oil, agricultural machinery oil, continuously variable transmission oil, manual transmission oil, automatic transmission oil, electric vehicle transmission oil, mobile natural gas oil, stationary natural gas oil, power railroad engine oil, power generation oil, hydraulic oil, dual fuel oil, tractor hydraulic fluid oil, anti-wear hydraulic fluid oil, hybrid driveline oil, motorcycle oil, grease, grease used under reduced pressure or high vacuum, reduction gears, hydraulic equipment, bearings used in aircraft, rockets, space engineering machinery, robot joints, or vacuum pump lubricating oil composition.

In embodiments, the lubricating composition is used for cooling or lubricating one or more components selected from an engine, power electronics, a rotor, a stator of the engine, or a battery in automobiles.

In embodiments, the lubricating composition is for use in electric and hybrid vehicles, e.g., lubricating reduction gear, or rotor/stator couple of an engine of an electric vehicle.

EXAMPLES

The components used in the examples are as follows.

The bio-base oil in the examples is a decarboxylated rosin acid (DCR). DCR samples are from Kraton Corporation and has properties as shown in Table 1. The DCR samples also have the followings for DCR1, DCR2, DCR3, DCR4, and DCR5 respectively: aromatic MW252 of 15.7, 14.0, 4, 4.1, and 0; reactive double bond MW 254 of 0.1, 0.5, 16, 17.1, and 0; aromatic MW256 of 40.3, 45.3, 36, 38.8, and 26; and cycloaliphatic MW260 of 0.7, 0.3, 31.4, 31.8, and 0; reactive double bond MW 258 of 0.4, 0.8, 4.5, and 3.8 (for DCR1, DCR2, DCR3, and DCR4, respectively); % $O_2$ content of 0.39 and 0.1 and % tricyclic species of 69.5 and 77.7 (for DCR1 and DCR2, respectively).

TABLE 1

| | DCR Samples | | | | |
|---|---|---|---|---|---|
| | DCR 1 | DCR 2 | DCR 3 | DCR 4 | DCR 5 |
| Acid Number (mg KOH/g) | 7 | 2 | 4.5 | 2.3 | 0.1 |
| Color | — | 1 | 9.8 | 3.4 | 0.0 |
| Viscosity, cSt @ 40° C. | 45.3 | 25.2 | 39.3 | 32.8 | 17.5 |
| Density, @ 40° C. | 0.95 | 0.95 | 0.94 | 0.962 | 0.9215 |
| Sulfur (ppm) | 274 | 66 | 419 | 187 | <5 |
| Flash Point, COC | 140 | 141 | n/a | 158 | 124 |
| Aniline Point | 14 | 13 | 14 | 15 | N/A |
| Pour Point | −14 | −26 | −18 | −24 | −33 |

Viscosity Improver 1 (VI 1) is a linear diblock copolymer based on styrene and ethylene/propylene with a polystyrene content of 37%, and a viscosity of 17 cSt at 100° C.

Viscosity Improver 2 (VI 2) is polymethylmethacrylate with a viscosity of 925 cSt at 100° C. and a density of 0.984 g/cm3 at 15° C. per ASTM D4052.

1349 is an extreme pressure/anti-wear additive of amine phosphates with a viscosity of 2390 $mm^2/s$ at 40° C., a melting point of <10° C., and a density of 0.92 $g/cm^3$ at 20° C.

VEZ is a multifunctional additive of concentrated zinc diamyldithiocarbamate, with a sulfur content of 21.0% minimum, a zinc content of >10.5% minimum, a color of 4.0 maximum, and a viscosity at 100° C. of 55 cSt.

V73 is a dithiocarbamate additive viscosity of 11 cSt at 100° C., a color of <7.0 and a sulfur content of 10.0-12.5.

TOFA 1 is tall oil fatty acid with an acid number of 194, a Gardner color of 4.5, and % rosin acids of 2.5.

TOFA 2 is tall oil fatty acid with an acid number of 178, a Gardner color of 5, and % free rosin acids of 39.

Paraffinic oil is a commercially available paraffinic mineral oil with a viscosity of 38.3 cSt at 40 C.

Naphthenic oil is a commercially available naphthenic mineral oil with a viscosity of 20.40 cSt at 40° C., a flashpoint of 166° C., an aniline point of 79.6° C.

Estolide is made from TOFA 1 by adding sulfuric acid and heating to 85° C. (top temperature) over a 24-hour time period, increasing the temperature 10° C. every five hours to achieve an acid number of 153 mg/g.

SME is a commercially available soy methyl ester with molecular weight of about 296 g/mol.

OME is a commercially available oleic acid methyl ester with a molecular weight of ~296 g/mol.

IPO is a commercially available isopropyl oleate with a molecular weight of 325 g/mol.

2EHP is a commercially available ethylhexyl palmitate with a molecular weight of ~369 g/mol.

Methyl oleate is a fatty acid methyl ester with an acid value of <4, an iodine value of 75-90, a Gardner color of <6.

PAO 4 is a is a low viscosity polyalphaolefin basestock with a viscosity index of 126, according to ASTM D2270, and a kinematic viscosity of 4.1 cSt at 100° C., according to ASTM D445.

PAO 40 is a high viscosity polyalphaolefin basestock with a viscosity index of 147, according to ASTM D2270, and a kinematic viscosity of 39 cSt at 100° C., according to ASTM D445.

PAO 60 is a high viscosity polyalphaolefin basestock blended from PAO 40 and PAO 100 to reach a kinematic viscosity of −60 cSt at 100° C., according to ASTM D445.

PAO 100 is a high viscosity polyalphaolefin basestock with a viscosity index of 170, according to ASTM D2270, and a kinematic viscosity of 100 cSt at 100° C., according to ASTM D445.

AN 5 is an alkylated naphthalene with a viscosity index of 74, according to ASTM D2270, and a kinematic viscosity of 4.7 cSt at 100° C., according to ASTM D445.

AN 23 is an alkylated naphthalene with a viscosity index of 116, according to ASTM D2270, and a kinematic viscosity of 20.5 $mm^2/s$ at 100° C., according to ASTM D445.

HFE is a clear-colorless liquid composed of 1-methoxy-heptafluoropropane ($C_3F_7OCH_3$), with a pour point of −122° C., a kinematic viscosity of 0.32 cSt at 25° C., a dielectric constant of 7.4 and a volume resistivity of $10^8$ Ohm-cm.

SBO is a Group III specialty base oil with a pour point of −24° C. per ASTM D5950, a density of 0.83 at 15° C. per ASTM D4052, and a viscosity of 21.3 at 40° C. per ASTM D445.

EBL is a dielectric cooling liquid with a density of 916 $kg/m^3$ at 20° C. per ISO3675, a kinematic viscosity of 16.4 $mm^2/s$ at 20° C. per ISO 3104, and a thermal conductivity of 0.129 at 20° C. per ASTM D7896.

AP is Lubrizol 1510 PCMO, an additive package for use in engine oils meeting GF-δspecifications.

The compositions in the examples were subjected to a high frequency reciprocating rig test (ASTM D6079) wherein the percent film, coefficient of friction and wear scar diameter are measured. The results of the HRFF test are shown in Table 2-4 below.

The compositions were also evaluated to determine four-ball anti-wear properties pursuant to ASTM D4172-94. The four-ball anti-wear properties measured include frictional torque, coefficient of friction, and wear scar diameter and are set forth in Tables 5-6 below.

The DCR and other base/secondary oils were subjected to HFRR tests. Results are shown in Table 2 below. No other components, e.g., additives, etc., were added to the indicated oils.

TABLE 2

HFRR Results for Neat Oils

| Sample | Film (%) | Friction Coefficient | Wear Scar Diameter (μm) |
|---|---|---|---|
| Paraffinic oil | 72 | 0.133 | 290 |
| Naphthenic oil | 53 | 0.162 | 307 |
| DCR 2 | 96 | 0.104 | 152 |
| DCR 1 | 98 | 0.096 | 128 |

TABLE 2-continued

HFRR Results for Neat Oils

| Sample | Film (%) | Friction Coefficient | Wear Scar Diameter (μm) |
|---|---|---|---|
| DCR 4 | 95 | 0.097 | 146 |
| DCR 3 | 97 | 0.099 | 135 |
| DCR 5 | — | 0.150 | 315 |
| IPO | 70 | 0.123 | 378 |
| 2EHP | 69 | 0.120 | 368 |
| OME | 95 | 0.107 | 191 |
| SME | 84 | 0.121 | 410 |

Lubricating oil samples were prepared using paraffinic oil as a base oil with minor amounts of bio-based oil DCR and/or various secondary oils as indicated. The samples were mixed at room temperature. The samples were then subjected to HFRR tests. The results are in Table 3 below.

TABLE 3

| Sample | Bio-based Oil or Secondary oil (wt. %) | Film (%) | Friction Coefficient | Wear Scar Diameter (μm) |
|---|---|---|---|---|
| Paraffinic oil, control | 0 | 72 | 0.133 | 290 |
| DCR 3 | 1 | 88 | 0.130 | 231 |
| DCR 4 | 1 | 91 | 0.123 | 221 |
| DCR 1 | 1 | 85 | 0.125 | 270 |
| DCR 2 | 1 | 68 | 0.139 | 286 |
| DCR 5 | 1 | 54 | 0.153 | 308 |
| naphthenic | 1 | 63 | 0.147 | 311 |
| SME | 1 | 89 | 0.130 | 233 |
| IPO | 1 | 85 | 0.128 | 248 |
| Estolide and DCR 2 (ratio 1:1) | 1 | 95 | 0.102 | 194 |

Lubricating oil samples were prepared using paraffinic oil as a base oil with minor amounts of bio-based oil DCR and/or extreme pressure/anti-wear additives as indicated. The samples were mixed at room temperature. The samples were then subjected to HFRR tests. The results are in Table 4 below.

TABLE 4

| Sample | Bio-based Oil or Secondary oil (wt. %) | Film (%) | Friction Coefficient | Wear Scar Diameter (μm) |
|---|---|---|---|---|
| Paraffinic oil, control | 0 | 72 | 0.133 | 290 |
| I 349 | 0.5 | 100 | 0.128 | 189 |
| DCR 1:I 349 (ratio 1:1) | 0.5 | 97 | 0.131 | 218 |
| DCR 1:I 349 (ratio 1:1) | 1.5 | 100 | 0.127 | 174 |
| DCR 1 | 1.5 | 93 | 0.120 | 213 |
| I 349 | 1.5 | 99 | 0.127 | 175 |
| DCR 1:I349 (ratio 3:1) | 1.5 | 97 | 0.127 | 175 |
| DCR 1:I349 (ratio 1:3) | 1.5 | 100 | 0.125 | 167 |

The DCR and other base/secondary oils were subjected to four-ball anti-wear tests. Results are shown in Table 5 below. No other components, e.g., additives, etc., were added.

TABLE 5

| Sample | Frictional Torque (kg-cm) | Friction Coefficient | Wear Scar Diameter (μm) |
|---|---|---|---|
| Naphthenic | 2.87 | 0.16 | 778 |
| DCR 1 | 1.81 | 0.10 | 1028 |
| DCR 2 | 2.01 | 0.11 | 1082 |
| Paraffinic | 2.45 | 0.13 | 665 |
| DCR 3 | 1.12 | 0.07 | 1037 |
| DCR 4 | 1.83 | 0.10 | 993 |
| OME | 2.00 | 0.11 | 693 |
| Olive oil | 1.59 | 0.09 | 633 |
| IPO | 2.22 | 0.12 | 712 |

Lubricating oil samples were prepared using paraffinic oil as a base oil with minor amounts of bio-based oil DCR and various additives, then evaluated for four-ball anti-wear properties. The lubricating oil samples contain 1.5 wt. % of bio-based oil DCR and/or additives as indicated in Table 6. The results are in Table 6 below.

TABLE 6

| Sample | Frictional Torque (kg-cm) | Friction Coefficient | Wear Scar Diameter (μm) |
|---|---|---|---|
| Paraffinic oil, control | 2.45 | 0.13 | 665 |
| I 349 | 1.29 | 0.07 | 388 |
| DCR 1 | 1.98 | 0.11 | 747 |
| I 349:DCR 1 (ratio 1:3) | 1.75 | 0.10 | 811 |
| I 349:DCR 1 (ratio 3:1) | 1.68 | 0.10 | 355 |
| CDCR | 2.79 | 0.15 | 751 |
| I 349:DCR 1 (ratio 1:3) | 1.94 | 0.10 | 371 |
| I 349:DCR 1 (ratio 3:1) | 1.67 | 0.09 | 370 |
| V73 | 2.18 | 0.13 | 808 |
| V73:DCR 1 (ratio 1:3) | 2.11 | 0.11 | 621 |
| V73:DCR 1 (ratio 3:1) | 2.28 | 0.12 | 718 |
| V73:DCR 1 (ratio 1:3) | 1.44 | 0.08 | 542 |
| V73:DCR 1 (ratio 3:1) | 2.12 | 0.11 | 763 |
| VEZ | 1.00 | 0.05 | 856 |
| VEZ:DCR 1 (ratio 1:3) | 1.35 | 0.07 | 483 |
| VEZ:DCR 1 (ratio 3:1) | 1.87 | 0.10 | 797 |
| VEZ:DCR 1 (ratio 1:3) | 1.43 | 0.08 | 562 |
| VEZ:DCR 1 (ratio 3:1) | 1.73 | 0.09 | 638 |

The bio-based oil DCR as a majority base oil was evaluated for compatibility with various viscosity index improvers. The examples were evaluated for dynamic viscosity and density of liquids by Stabinger Viscometer (ASTM D7042) where kinematic viscosity and viscosity index were determined. The indicated viscosity index improvers are blended with CLR at 130° C. for 1.5-2 hours. The results are shown in Table 7 below.

TABLE 7

| | DCR 2 | DCR 2 + 2.5 VI 1 | DCR 2 + 2.5 VI 2 | DCR 2 + 5.0 VI 1 |
|---|---|---|---|---|
| Acid Number | 2 | 1.9 | 1.9 | 1.9 |
| KV @40° C. | 21.0 | 92.9 | 31.6 | 303.0 |
| KV@100° C. | 2.8 | 11.8 | 4.8 | 31.4 |
| Density, @40° C. | 0.95 | 0.9 | 0.9 | 0.9 |
| Density, @100° C. | 0.91 | 0.9 | 0.9 | 0.9 |
| Viscosity index | −120.1 | 117.8 | 49.5 | 142.7 |

The bio-based oil DCR2 was evaluated for compatibility with polyalphaolefin and alkylated naphthalene base oils. DCR2 was added to the indicated base oil in the amounts indicated below in Table 8. The DCR was mixed with the base oil at 40-50° C. for −20 minutes. The results are in Table 8 below. A ranking of "clear" indicates samples had no haze or cloudiness (transparent).

TABLE 8

| | wt. % DCR 2 in Base Oil | | |
|---|---|---|---|
| Base oil | 5 | 10 | 20 |
| PAO 4 | Clear | Clear | Clear |
| PAO 40 | Clear | Clear | Clear |
| PAO 60 | Clear | Clear | Clear |
| PAO 100 | Clear | Clear | Clear |
| AN 5 | Clear | Clear | Clear |
| AN 23 | Clear | Clear | Clear |

The bio-based oil DCR5 was also evaluated for compatibility as outlined above. The results are in Table 9 below.

TABLE 9

| | wt. % DCR 5 in Base Oil | | |
|---|---|---|---|
| Base oil | 5 | 10 | 20 |
| PAO 4 | Clear | Clear | Clear |
| PAO 40 | Clear | Clear | Clear |
| PAO 60 | Clear | Clear | Clear |
| PAO 100 | Clear | Clear | Clear |
| AN 5 | Clear | Clear | Clear |
| AN 23 | Clear | Clear | Clear |

A lubricating composition was evaluated for weight change in the presence of steel according to FED-STD-791-5308 or ASTM D4636: Standard Test Method for Corrosiveness and Oxidation Stability of Hydraulic Oils, Aircraft Turbine Engine Lubricants, and Other Highly Refined Oils. The Control used is a mixture of 85 wt. % of PAO4 and a polyolester oil in an 80:20 ratio, 10 wt. % of additive package AP, and 5 wt. % viscosity index improver (made of 5 wt. % VI 1 in DCR1). Sample #1 contains 85 wt. % of PAO4 and DCR1 in an 80:20 ratio, 10 wt. % of additive package AP, and 5 wt. % viscosity index improver (made of 5 wt. % VI 1 in DCR1). The additive package AP was added to the base oil and mixed at 80° C. until clear. The viscosity index improver was then added and again mixed at 80° C. until clear. Results are in Table 10 below.

TABLE 10

| DCR Weight Change in the Presence of Steel | | |
|---|---|---|
| | Control | Sample #1 |
| % weight loss | 0.256 | 0.191 |
| % Viscosity change | −4.1 | −0.7 |
| Acid Number change | −0.4 | −1.2 |
| % Specimen weight change (steel) | 0.2045 | 0.0851 |

The bio-based oil DCR2 and other base oils were evaluated for hydrolytic stability using ASTM D2619 and a copper specimen.

TABLE 11

| Hydrolytic Stability for DCR 2 and other Base Oils (Neat) | | | | |
|---|---|---|---|---|
| | AN initial | % AN increase over initial | AN increase aqueous layer | Specimen loss, mg/cm$^2$ |
| Methyl oleate | 0.45 | −37.8 | 4.90 | 0.24 |
| IPO | 0.08 | 87.5 | 15.50 | 0.51 |
| DCR | 1.51 | −8.6 | 2.60 | 0.19 |
| Naphthenic oil | 0.02 | 0.0 | 0.90 | 0.03 |

The bio-based oil DCR was evaluated for electrical properties. Kinematic viscosity was measured at 20° C. per ASTM D445. Thermal conductivity was measured per ASTM D4308. Dielectric constant was measured per ASTM D924. Electrical conductivity was measured per ASTM D4308. Power factor (PF) was measured at 25° C. and 100° C. (as indicated below) per ASTM D924. Results are in Table 12 below.

TABLE 12

| | Kinematic Viscosity (cSt) | Density @ 20° C. (g/ml) | Thermal Conductvity (W/Mk) | Dielectric Constant | Specific Heat Capacity (J/kgK) | Electrical Conductivity (Ps/m) | PF 25° C. | PF 100° C. |
|---|---|---|---|---|---|---|---|---|
| DCR 2 | 70 | 0.96 | 0.098 | 2.31 | 1607 | 0.6 | 0.01 | 2.30 |
| DCR 5 | 56.3 | 0.94 | 0.093 | 2.05 | 1527 | 0.6 | 0.01 | 0.38 |

As used herein, the term "comprising" means including elements or steps that are identified following that term, but any such elements or steps are not exhaustive, and an embodiment can include other elements or steps. Although the terms "comprising" and "including" have been used herein to describe various aspects, the terms "consisting essentially of" and "consisting of" can be used in place of "comprising" and "including" to provide for more specific aspects of the disclosure and are also disclosed.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items.

Unless otherwise specified, all technical and scientific terms used herein have the same meanings as commonly understood by one of skill in the art to which the disclosed disclosure belongs. The recitation of a genus of elements, materials or other components, from which an individual component or mixture of components can be selected, is intended to include all possible sub-generic combinations of the listed components and mixtures thereof.

The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. To an extent not inconsistent herewith, all citations referred to herein are hereby incorporated by reference.

The invention claimed is:

1. A lubricating composition consisting essentially of:
at least 60 wt. % of a base oil;
0.1-40 wt. % of a decarboxylated rosin acid; and
up to 35.0 wt. % of an additive;
wherein the decarboxylated rosin acid has:
a density of 0.9 to 1.0 g/cm$^3$ at 20° C.;
a viscosity of 15 to 60 cSt at 40° C., measured according to ASTM D-445; and
an acid value of <50 mg KOH/g, as measured using ASTM D1240-14 (2018);
wherein the lubricating composition exhibits a wear scar diameter of <350 μm, according to ASTM D6079.

2. The lubricating composition of claim 1, wherein the decarboxylated rosin acid comprises one or more C═C groups, and 40-100 wt. % of tricyclic species having 18-20 carbon atoms.

3. The lubricating composition of claim 2, wherein sum of the tricyclic species as aromatic and cycloaliphatic in the decarboxylated rosin acid is >50 wt. %, based on total weight of the decarboxylated rosin acid.

4. The lubricating composition of claim 3, wherein amount of the tricyclic cycloaliphatic species in the decarboxylated rosin acid is >15 wt. %, based on total weight of the decarboxylated rosin acid.

5. The lubricating composition of claim 1, wherein the decarboxylated rosin acid has at least one of:
an aniline point of 3-40° C., according to ASTM D611;
a pour point of −40 to +10° C., according to ASTM D97;
a flash point of 95-175° C., according to ASTM D92;
a boiling point of 200-390° C., according to D2887;
a Gardner Color of 0-12.0, according to ASTM D6166;
a sulfur content of <500 ppm, according to ASTM D5453;
a Kb (Kauri butanol) value of 25-90, according to ASTM D1133;
a viscosity index of <−100, according to ASTM D2270;
a viscosity of 20-50 cSt, according to ASTM D-445 at 40° C.;
a thermal conductivity of about <0.3, according to ASTM D4308;
a dielectric constant of <5, according to ASTM D924;
a specific heat capacity of 1475-1800, according to ASTM E1269;
an electrical conductivity of <3 Ps/m, according to ASTM D4308; and
a Power Factor at 100° C. of 0.01-3, according to ASTM D924.

6. The lubricating composition of claim 1, wherein the decarboxylated rosin acid is unhydrogenated, and wherein the unhydrogenated decarboxylated rosin acid has at least one of:
a C19 species with a MW of 262 in an amount of 5-20 wt. %;
a C19 species with a MW of 260 in an amount of 5-25 wt. %;
a C19 species with a MW of 256 in an amount of 35-55 wt. %;
a C19 species with a MW of 252 in an amount of 5-20 wt. %;
a C13 species with a MW of 180 in an amount of 0-5 wt. %; and
a C13 species with a MW of 174 in an amount of 5-25 wt. %.

7. The lubricating composition of claim 6, wherein the unhydrogenated decarboxylated rosin acid has at least one of:

a flash point of 135-175° C., according to ASTM D92;

a Kb (Kauri butanol) value of 25-90, according to ASTM D1133; and a Power Factor at 100° C. of 1-3, according to ASTM D924.

8. The lubricating composition of claim 1, wherein the decarboxylated rosin acid is hydrogenated, and wherein the hydrogenated decarboxylated rosin acid has at least one of:

a C19 species with a MW of 262 in an amount of 25-100 wt. %;

a C19 species with a MW of 260 in an amount of 0-5 wt. %;

a C19 species with a MW of 256 in an amount of 0-40 wt. %;

a C19 species with a MW of 252 in an amount of 0-5 wt. %;

a C13 species with a MW of 180 in an amount of 0-20 wt. %; and a C13 species with a MW of 174 in an amount of 0-5 wt. %.

9. The composition of claim 8, wherein the hydrogenated decarboxylated rosin acid has at least one of:

a pour point of −40 to −10° C., according to ASTM D97;

a flash point of 95-140° C., according to ASTM D92;

a Gardner Color of <1, according to ASTM D6166;

a sulfur content of 0.001-10 ppm, according to ASTM D5453;

an acid value of <1 mg KOH/g, according to ASTM D1240-14 (2018) or ASTM D465; and a Power Factor at 100° C. of 0.01-2, according to ASTM D924.

10. The lubricating composition of claim 1, wherein the additive is selected from the group of antioxidants, friction modifiers, detergents, corrosion inhibitors, copper corrosion inhibitors, antifoam agents, seal-swell agents, extreme pressure agents, anti-wear agents, viscosity modifier, dispersant, metal deactivators, demulsifiers, pour point depressants, and combinations thereof.

11. The lubricating composition of claim 10, wherein the additive is an anti-wear or extreme pressure additive, and wherein the anti-wear or extreme pressure additive is present in a weight ratio of anti-wear or extreme pressure additive to decarboxylated rosin acid of 10:90 to 90:10.

12. The lubricating composition of claim 1, wherein the base oil is selected from the group of natural oils, mineral oils, vegetable oils, synthetic oils, and mixtures thereof.

13. The lubricating composition of claim 1, wherein the lubricating composition is used in electric or hybrid-electric vehicles.

14. The lubricating composition of claim 13, wherein the lubricating composition is used for cooling one or more components selected from an engine, power electronics, a rotor, a stator of the engine, or a battery.

15. The lubricating composition of claim 13, wherein the lubricating composition has at least one of:

an electrical conductivity of 10 pS/m to 80,000 pS/m, according to ASTM D4308;

a dielectric constant of 1-5, according to ASTM D924; and a kinematic viscosity of 2-20 cSt, according to ASTM D445 at 100° C.

16. The lubricating composition of claim 1, wherein the lubricating oil is an automotive engine oil, marine oil, gear oil, agricultural machinery oil, continuously variable transmission oil, manual transmission oil, automatic transmission oil, mobile natural gas oil, stationary natural gas oil, power railroad engine oil, power generation oil, hydraulic oil, dual fuel oil, tractor hydraulic fluid oil, anti-wear hydraulic fluid oil, motorcycle oil, or grease.

17. A method of lubricating metal surfaces comprising supplying to the metal surfaces a lubricating composition consisting essentially of:

at least 60 wt. % of a base oil;

0.1-40 wt. % of a decarboxylated rosin acid; and up to 35.0 wt. % of an additive;

wherein the decarboxylated rosin acid has:

a density of 0.9 to 1.0 g/cm$^3$ at 20° C.;

a viscosity of 15 to 60 cSt at 40° C., measured according to ASTM D-445; and an acid value of <50 mg KOH/g, as measured using ASTM D1240-14 (2018);

wherein the lubricant composition exhibits a wear scar diameter of <350 μm, according to ASTM D6079.

18. The method of lubricating metal surfaces of claim 17, wherein the decarboxylated rosin acid comprises one or more C═C groups, and 40-100 wt. % of tricyclic species having 18-20 carbon atoms.

19. The method of lubricating metal surfaces of claim 18, wherein sum of tricyclic species as aromatic and cycloaliphatic in the DCR is >50 wt. %, based on total weight of the decarboxylated rosin acid.

20. The lubricating composition of claim 17, wherein the decarboxylated rosin acid is added to the base oil in a ratio of base oil to decarboxylated rosin acid in an amount of 60:40 to 95:5.

* * * * *